US009498878B2

(12) United States Patent
Barker

(10) Patent No.: US 9,498,878 B2
(45) Date of Patent: Nov. 22, 2016

(54) INSULATE HIGH VOLTAGE EXTENSION FOR SOCKET WRENCH

(71) Applicant: Fred Barker, Hesperia, CA (US)

(72) Inventor: Fred Barker, Hesperia, CA (US)

( * ) Notice: Subject to any disclaimer, the term of this patent is extended or adjusted under 35 U.S.C. 154(b) by 317 days.

(21) Appl. No.: 14/489,816

(22) Filed: Sep. 18, 2014

(65) Prior Publication Data

US 2016/0082582 A1 Mar. 24, 2016

(51) Int. Cl.

| | |
|---|---|
| ***B25G 1/12*** | (2006.01) |
| ***B25B 23/14*** | (2006.01) |
| ***B25G 1/04*** | (2006.01) |
| ***B25B 23/00*** | (2006.01) |

(52) U.S. Cl.

CPC ..... *B25G 1/125* (2013.01); *B25B 23/0007* (2013.01); *B25B 23/0014* (2013.01); *B25B 23/0021* (2013.01); *B25B 23/1415* (2013.01); *B25G 1/043* (2013.01)

(58) Field of Classification Search

CPC ..... B25G 1/125; B25G 1/043; B25G 1/005; B25B 23/0007; B25B 23/0021; B25B 23/0014; B25B 23/1415; H02G 1/02; H01H 31/006; Y10T 16/48

See application file for complete search history.

(56) References Cited

U.S. PATENT DOCUMENTS 1,946,239 A * 2/1934 Ryan ..... B25G 1/125 174/138 R
2,057,201 A * 10/1936 McCluskey ..... B25B 7/00 294/118
2,963,930 A 12/1958 Clothier et al.
2,997,529 A * 8/1961 Fink ..... H01B 3/008 156/296
3,688,017 A * 8/1972 Roots ..... H01H 31/006 156/172
4,047,821 A * 9/1977 Hoke ..... B25G 1/04 24/265 B
4,123,953 A * 11/1978 Corbacho, Jr. ..... B25G 1/125 76/114
4,344,340 A 8/1982 Erickson
4,703,677 A 11/1987 Rossini
4,960,015 A 10/1990 Mathews
5,259,277 A * 11/1993 Zurbuchen ..... B25B 15/02 81/177.1
2,438,633 A 11/1994 Condor
5,626,061 A * 5/1997 Whitley ..... B25B 13/461 76/114
5,700,543 A * 12/1997 Bendick ..... B29C 44/1209 428/111
6,035,747 A 3/2000 Valela
6,092,441 A * 7/2000 Jarvis ..... B25B 23/0021 81/177.2
6,135,607 A * 10/2000 Cook ..... B25B 23/0021 362/109
6,199,456 B1 * 3/2001 Hlady ..... B25G 1/005 81/125.1
6,216,566 B1 * 4/2001 Zurbuchen ..... B25G 1/063 81/177.1
7,103,934 B1 9/2006 Hsu et al.
8,104,382 B2 * 1/2012 Hu ..... B25B 23/0014 403/57
8,151,671 B2 * 4/2012 Chen ..... B25B 23/0014 403/57
9,021,922 B2 * 5/2015 Lai ..... B25B 13/46 81/60
9,321,158 B2 * 4/2016 Calvert ..... B25B 23/0035 81/53.1

(Continued)

*Primary Examiner* — David B Thomas

(74) *Attorney, Agent, or Firm* — Kirk A. Buhler; Buhler & Associates

(57) ABSTRACT

Improvements in an insulated high voltage extension for a socket wrench is disclosed. The extension provides electrical isolation between an operator located at one end of the insulated extension and a nut or bolt located at the other end of the insulated extension. Due to the potential for high voltage electricity to jump between conductive elements the insulated high voltage extension provides electrical isolation to reduce or prevent electrocution of an installer when the installer is working with high voltage power transmission lines. The extension can have a universal joint option that allows an operator to be slightly out-of-alignment with the nut or bolt. The extension can have a sacrificial torque limiter to prevent an installer from continuing to tighten or loosen a nut or bolt beyond a limit that can cause damage to the extension.

20 Claims, 3 Drawing Sheets

(56) References Cited

U.S. PATENT DOCUMENTS

2002/0121164 A1* 9/2002 Somers ..... B25B 23/0014 81/177.75
2007/0062343 A1* 3/2007 Dodson ..... B25G 1/043 81/177.2
2011/0101716 A1* 5/2011 Nolte ..... B25G 1/04 294/174
2012/0111159 A1* 5/2012 Wu ..... B25B 13/461 81/467
2012/0111160 A1* 5/2012 Wu ..... B25B 23/1422 81/467
2012/0174716 A1* 7/2012 Tsai ..... B25B 13/461 81/60
2013/0098212 A1* 4/2013 Ingersoll ..... B25G 1/043 81/177.2
2013/0160617 A1* 6/2013 Hsieh ..... B25B 23/1427 81/467
2013/0319189 A1* 12/2013 Kuo ..... B25G 1/105 81/460
2014/0053689 A1* 2/2014 Lai ..... B25B 13/46 81/60
2014/0182425 A1* 7/2014 Kuo ..... B25G 1/125 81/489

* cited by examiner

| Nominal voltage in kilovolts | Distance: Phase to ground exposure |
|---|---|
| 0.05 to 1.0 | Avoid contact |
| 1.1 to 15.0 | 2'-1" (0.64m) |
| 15.1 to 36.0 | 2'-4" (0.72m) |
| 36.1 to 46.0 | 2'-7" (0.77m) |
| 46.1 to 72.5 | 3'-0" (0.90m) |
| 72.6 to 121 | 3'-2" (0.95m) |
| 138 to 145 | 3'-7" (1.09m) |
| 161 to 169 | 4'-0" (1.22m) |
| 230 to 242 | 5'-3" (1.59m) |
| 345 to 362 | 8'-6" (2.59m) |
| 500 to 550 | 11'-3" (3.42m) |
| 764 to 800 | 14'-11" (4.53m) |

50 51 52

INSULATE HIGH VOLTAGE EXTENSION FOR SOCKET WRENCH

CROSS REFERENCE TO RELATED APPLICATION

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

Field of the Invention

This invention relates to improvements in an extension for use with high voltage power lines. More particularly, the present extension allows a high voltage worker to safely loosen and tighten nuts on high voltage power lines.

Description of Related Art Including Information Disclosed Under 37 CFR 1.97 and 1.98

Working on high voltage power lines requires a high level of care for insulation from the high voltage that runs through the power lines. Typical high voltage lines have voltages as high as 2.4 to 756 kilo-volts. The high voltage power lines consist of aluminum or copper conducting lines. The aluminum and copper elements improve the conductivity. A high-voltage line has a reduced surface space. Since less heat is lost through the surface of the conductor, less electrical energy is lost through the process. This enables a greater abundance of electric power to reach the substations more efficiently. The high voltage requires a worker to insulate themselves from the high voltage to prevent electrocution.

Because the took are for high voltage handling are for special purposes the number of related patents are limited to address these issues. Exemplary examples of patents and or publication that try to address this/these problem(s) are identified and discussed below.

U.S. Pat. No. 6,035,747 issued on Mar. 14, 2000 to Joseph Valela discloses an Extension for Socket Wrenches Having Improved Torque Characteristics. This extension is fabricated from a steel shaft with metal sockets on each end. The extension shaft provides improved torque characteristics that provide optimal forces to loosen or tighten a nut or bolt. Because this is a conductive extension electricity can easily pass from the nut or bolt to the person working on the nut or bolt. The improved torque characteristics further can damage the nut or bolt by over torqueing. Both the conductive nature and the high torque capability are features that are not desirable when working with high voltage power lines.

U.S. Pat. No. 7,103,934 issued on Sep. 12, 2006 to Eric Hsu et al discloses a Multipurpose Combination Pliers. The pliers have a male socket on one end where a wrench can be secured. Once the wrench is secured a user can use a socket wrench to turn a nut, bolt or other object being gripped by the jaws of the wrench. Again, the conductive nature of the pliers and the ability to damage a nut or bolt secured by the pliers creates undesirable features.

What is needed is an insulated high voltage extension for a socket wrench that provides electrical isolation of the user from the nut or bolt and limits the amount of torque that can be applied from an attached wrench to a nut.

BRIEF SUMMARY OF THE INVENTION

It is an object of the insulated high voltage extension for a socket wrench to provide electrical isolation between an operator located at one end of the insulated high voltage extension and a nut or bolt located at the other end of the insulated high voltage extension. Due to the potential for high voltage electricity to jump between conductive elements the insulated high voltage extension provides electrical isolation to reduce or prevent electrocution of an installer when the installer is working with high voltage power transmission lines. This can especially be a problem when working with high voltage power transmission lines in high humidity and in wet conditions. Typically repair is performed on high power transmission lines following a storm.

It is an object of the insulated high voltage extension for a socket wrench to be available is different lengths to allow an installer to use an extension that is optimal for the voltage, conditions and the distance between the installer and the fastener. While the length of the extension can be between four (4) feet and 15 feet depending upon the voltage, other shorter and longer lengths are contemplated.

It is another object of the insulated high voltage extension for a socket wrench to include a universal joint option. The universal joint option allows an operator to be slightly out-of-alignment with the nut or bolt. In many installations the operator is not at an optimal location due to the equipment the operator is standing upon and or the configuration of the high power lines. The universal joint accommodates the miss-alignment without limiting other functions of the insulated high voltage extension. While the universal joint can be integrated into the insulated high voltage extension, it is also possible that the operator can install their own universal joint onto either or both ends of the insulated high voltage extension.

It is still another object of the insulated high voltage extension for a socket wrench for the wrench to have a sacrificial torque limiter. The sacrificial torque limiter prevents an installer to continue to tighten or loosen a nut or bolt beyond a limit that can cause damage to the high voltage extension. In some cases an installer will continue to apply greater forces to turn a nut or bolt in an attempt to form or cut threads. While the over torqueing can allow the nut or bolt to be initially installed, the cause of the problem is not addressed and the result can cause damage that must be repaired in the future.

Various objects, features, aspects, and advantages of the present invention will become more apparent from the following detailed description of preferred embodiments of the invention, along with the accompanying drawings in which like numerals represent like components.

BRIEF DESCRIPTION OF THE SEVERAL VIEWS OF THE DRAWING(S)

DETAILED DESCRIPTION OF THE INVENTION

Figure 1:
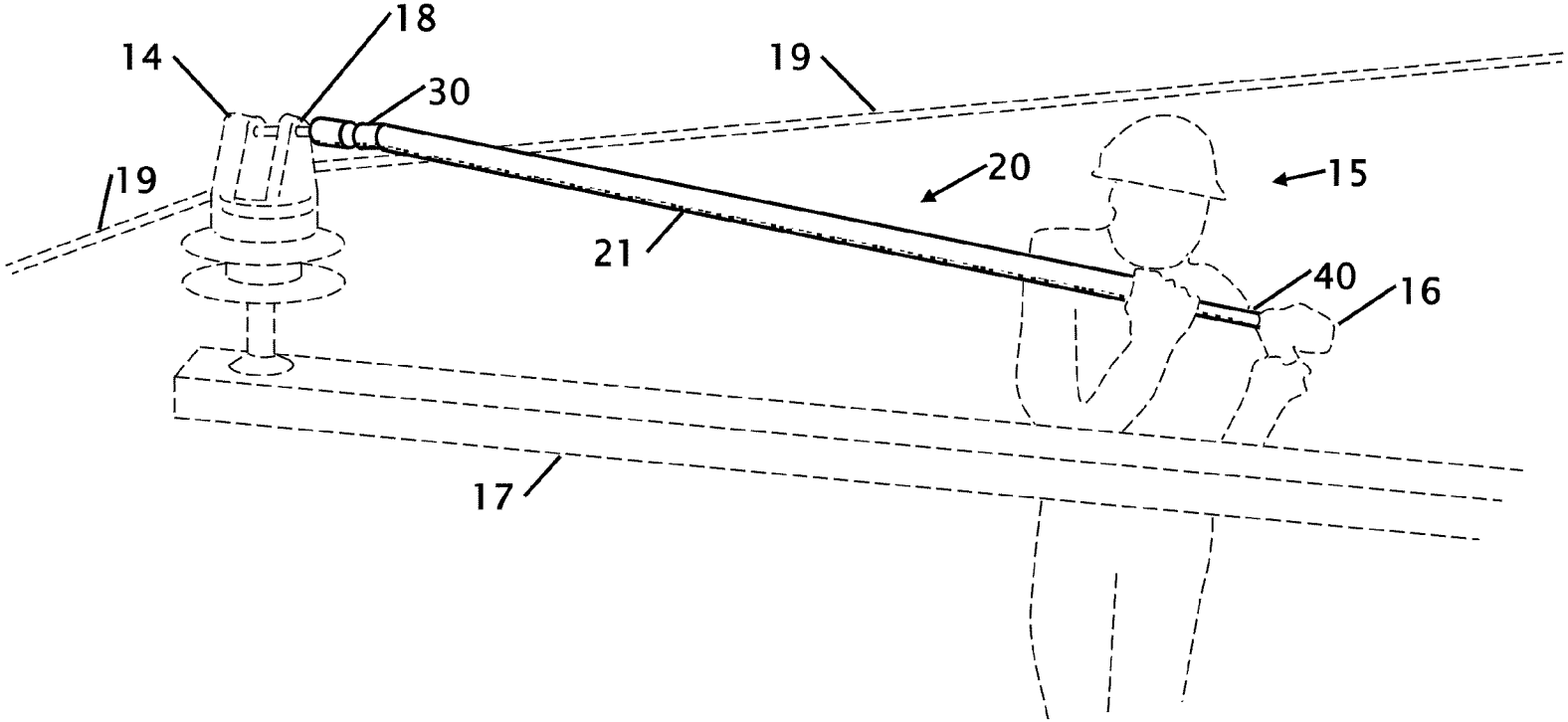
FIG. 1 shows an insulated high voltage extension for a socket wrench being used.

FIG. 1 shows an insulated high voltage extension for a socket wrench. This figure shows the length of the extension 20 at about four (4) feet in length. From this figure, the extension 20 is shown with a first end 30 secured to a fastener 18 on an insulator 14 on high voltage power transmission line 19. The power transmission line(s) 19 are typically elevated above a location where a person can come in contact with the power lines and are often placed at a height above where a person can throw an object. The installer is typically elevated to this position with an insulated lift, but can also climb the power pole to access the insulators 14 and power line 19.

As the voltage increases the height above the ground also typically increases as well as the safe distance between the operator 15 and the power line 19. The insulator 14 is usually made of glass or other material that provides insulation and is non-porous. The insulator 14 is shown mounted to the horizontal cross-member 17 of a power pole. As this figure shows, the worker 15 is able to perform maintenance of installation tasks at a distance from the insulator 14 on the power line 19.

The other end 40 of the extension 21 is shown connected to a wrench 16. In this case the wrench 16 is an battery powered driver, but could also be a mechanical wrench with a torque indicator that allows an operator to set the desired amount of torque for the given fastener 18. The electric driver wrench 16 allows the operator to quickly thread and remove the fastener 18 into the insulator 14. The first end, or driven end 30 accepts standard sockets and has a square drive of ½ inch but can have larger or smaller sizes as well as metric sizes. The driven end has at least one universal type coupler to accept some rotational axial miss-alignment between the centerline of the shaft 21 and the centerline where the fastener 18 will be driven and seated.

Figure 2:
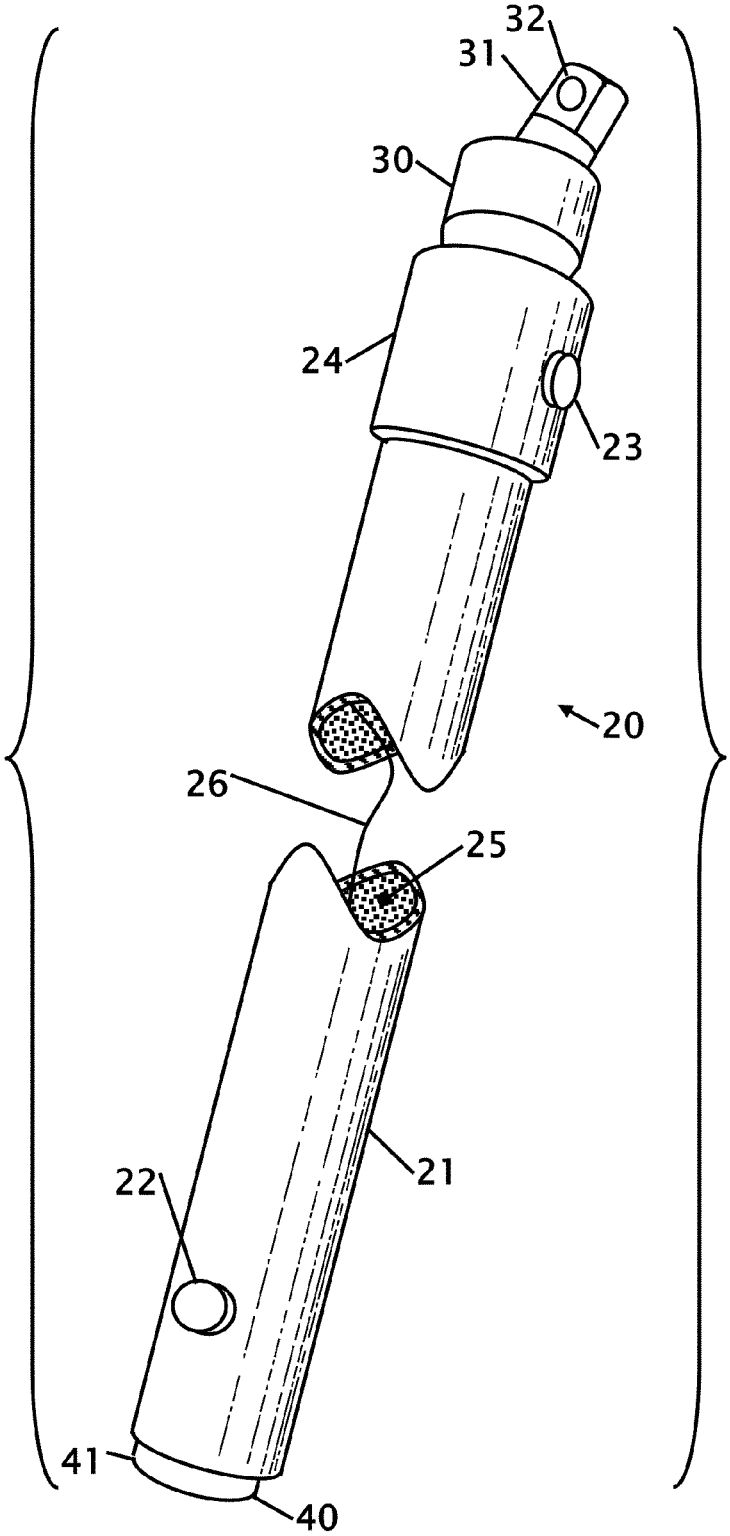
FIG. 2 shows a detailed view of the insulated high voltage extension

FIG. 2 shows a detailed view of the insulated high voltage extension. Starting at the bottom of this figure the driver side 40 is located. The driver side has a ½" female socket that accepts a male socket stub that is found on socket wrenches and torque drivers. The driver side female socket is typically made from metal and is conductive by nature. While non-conductive sockets can be used, they typically have reduced life or operation and/or offer lower torque capability. The female drive socket is connected to the insulation tube 21.

The insulated tube 21 is preferably fabricated from a material that has high torque capability. The connection from the female drive socket 40 to the insulated tube is with a pin 22. In one embodiment the pin 22 is a shear pin that can shear is the torque being applied exceeds a desired limit. The shear pin 22 can be retained on the insulated tube with a cotter pin or other mechanism where the shear pin 22 can be replaced based upon the desired amount of torque limit desired. In many cases the person applying torque to a fastener can easily exceed the optimal torque as they quickly try to replace, install or repair the power line To prevent parts of the extension tube 20 from falling if the pin should shear an "E" clip or "C" ring 41 retainer is utilized.

The broken area of the insulated tube 21 is shown as hollow or filled with foam 25. While a solid insulated shaft 21 could be used, in the preferred embodiment the insulated shaft is hollow and foam filled 25 to prevent moisture contamination. At the opposing or driven end of the extension tube, the insulated shaft 21 is connected to a collar 24 with a fastener 23. The fastener 23 could also be a sheer pin, but a duplicate sheer pin 23 is functionally redundant. At the end of the collar 24 an impact swivel 30 that is connected to the collar 24.

A ball joint in the coupler 30 with a male socket 31 that has a square drive 31. The ball joint allows the square drive 31 to pivot to accommodate some axial miss-alignment between the centerline of the extension tube 20 and the centerline of a fastener that is being installed or removed. The square drive 31 is the preferred ½" drive cross-section, but could be a hex drive or larger if required. The square drive 31 has a spring loaded ball 32 that retains a socket onto the square drive 31.

Figures 3, 4:
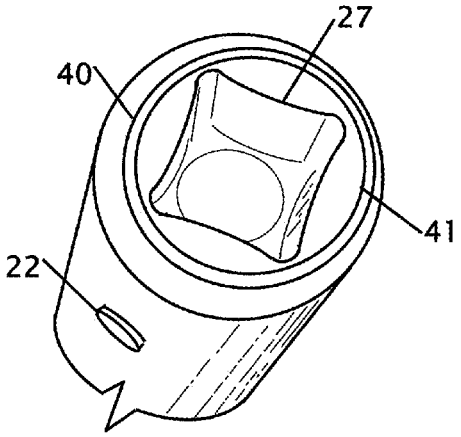
FIG. 3 shows the female socket side of the insulated high voltage extension
FIG. 4 shows a table of the distance phase to ground exposure based upon different nominal voltages.

FIG. 3 shows the female socket side of the insulated high voltage extension 20. This end view looks into the female hole in the end of the drive socket 40. This image shows the sheer pin 22. The female hole 27 is shown as a preferred square ½" drive. The square drive is the preferred, but could be a hex drive or other power transmission shape. Essentially, the drive type of the female socket 27 is the same as the ½" male drive type on the opposing side of the extension tube 20.

FIG. 4 shows a table of the distance phase 51 to ground exposure based upon different nominal voltages 50. This table shows the safe distances and essentially the lengths of the insulated extension pole. While this chart shows 12 different nominal voltages where 12 different lengths of extension tubes can be used, in practicality two to four lengths would give an operator versatility without creating an excessive number of extension tubes to transport. From this table a single nominal voltage of 100 kilovolts would require a minimum safe exposure distance of 3 feet and 2 inches. An extension tube of six feet would accommodate this voltage. As the length of the extension tube becomes greater the inside and outside diameters of the extension tubes might need adjustment to reduce bending of the tube at longer lengths of 15 feet to provide a safe working distance between the power line and the operator.

In operation the operator ascends to the area where they will work. The operator selects an insulated extension pole based upon the minimal safe distance to the power line. The operator selects a socket that matched the head of the fastener and secures the socket to the male end of the extension pole. The fastener is then inserted into the socket. The extension is then moved to align the fastener to the threaded hole. The fastener can then be hand started to thread the fastener into the hole. A power driver can then be secured to the female hole in the extension and the power driver can be operated to seat the fastener.

Thus, specific embodiments of an insulated high voltage extension for a socket wrench have been disclosed. It should be apparent, however, to those skilled in the art that many more modifications besides those described are possible without departing from the inventive concepts herein. The inventive subject matter, therefore, is not to be restricted except in the spirit of the appended claims.

The invention claimed is:

1. An insulated high voltage extension for a socket wrench comprising:

an electrically non-conductive elongated shaft;

said electrically non-conductive elongated shaft having a first end with a female receiver ½" impact swivel;

said electrically non-conductive elongated shaft having a second end with a male stub receiver;

said female receiver being a coupler for a wrench or battery impact tool;

said male stub receiver being a coupler for a socket or tool head;

said electrically non-conductive elongated shaft having a length that is at least that exceeds a safe working distance for a given nominal voltage.

2. The insulated high voltage extension for a socket wrench according to claim 1 wherein said electrically non-conductive elongated shaft is hollow or foam filled.

3. The insulated high voltage extension for a socket wrench according to claim 1 wherein said electrically non-conductive elongated shaft is solid.

4. The insulated high voltage extension for a socket wrench according to claim 1 wherein said elongated shaft is made from non-conductive plastic.

5. The insulated high voltage extension for a socket wrench according to claim 1 wherein said elongated shaft is molded or extruded.

6. The insulated high voltage extension for a socket wrench according to claim 1 wherein said coupler for a socket further includes a pivoting ball joint.

7. The insulated high voltage extension for a socket wrench according to claim 6 wherein said pivoting ball joint accommodates axial miss-alignment.

8. The insulated high voltage extension for a socket wrench according to claim 1 wherein said insulated high voltage extension further includes a sheer pin.

9. The insulated high voltage extension for a socket wrench according to claim 8 wherein said sheer pin is located between said non-conductive elongates shaft and said coupler for a wrench.

10. The insulated high voltage extension for a socket wrench according to claim 8 wherein said sheer pin is located between said non-conductive elongates shaft and said coupler for a socket.

11. The insulated high voltage extension for a socket wrench according to claim 8 further includes a retaining clip or ring.

12. The insulated high voltage extension for a socket wrench according to claim 11 wherein said safety pin is connected between said coupler for a wrench and said coupler for a socket through said non-conductive elongated shaft.

13. The insulated high voltage extension for a socket wrench according to claim 8 wherein said sheer pin is replaceable.

14. The insulated high voltage extension for a socket wrench according to claim 8 wherein said sheer pin creates a torque limiter.

15. The insulated high voltage extension for a socket wrench according to claim 1 further includes a non-conductive safety line.

16. The insulated high voltage extension for a socket wrench according to claim 1 wherein said between said coupler for a wrench and said coupler for a socket are for a ½" square drive.

17. The insulated high voltage extension for a socket wrench according to claim 1 wherein said coupler for a wrench is electrically conductive.

18. The insulated high voltage extension for a socket wrench according to claim 1 wherein said coupler for a socket is electrically conductive.

19. The insulated high voltage extension for a socket wrench according to claim 1 wherein said insulated high voltage extension electrically isolates said coupler for a wrench and said coupler for a socket.

20. The insulated high voltage extension for a socket wrench according to claim 1 wherein said electrically non-conductive elongated shaft is between two feet and 15 feet in length.

* * * * *